US011852400B2

(12) United States Patent
Leibman et al.

(10) Patent No.: US 11,852,400 B2
(45) Date of Patent: Dec. 26, 2023

(54) REFRIGERATOR APPLIANCE WITH IMPROVED STORAGE

(71) Applicant: Haier US Appliance Solutions, Inc., Wilmington, DE (US)

(72) Inventors: Alexander B. Leibman, Prospect, KY (US); Venkata Chakradhar Rangu, Louisville, KY (US); Neelapala Gopinath Yadav, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 49 days.

(21) Appl. No.: 17/401,741

(22) Filed: Aug. 13, 2021

(65) Prior Publication Data

US 2023/0050469 A1 Feb. 16, 2023

(51) Int. Cl.
*F25D 25/00* (2006.01)
*F25D 25/02* (2006.01)

(52) U.S. Cl.
CPC ..... *F25D 25/005* (2013.01); *F25D 25/02* (2013.01)

(58) Field of Classification Search
CPC ... F25D 25/005; F25D 25/02; F25D 2331/807
See application file for complete search history.

(56) References Cited

U.S. PATENT DOCUMENTS 6,880,902 B2 4/2005 Zimmerman
9,386,886 B2 * 7/2016 Lee ..... A47J 47/20
D799,133 S 10/2017 Wong
D819,289 S 5/2018 Lee
D820,543 S 6/2018 Huang
D833,369 S 11/2018 Lan
D836,956 S 1/2019 Tsuchiyama
D843,889 S 3/2019 Belardo
D845,042 S 4/2019 Allen
D855,359 S 8/2019 Boettner
D869,809 S 12/2019 Dardashti
D870,800 S 12/2019 Xu
D877,601 S 3/2020 White
D878,700 S 3/2020 Dardashti
2006/0096929 A1 * 5/2006 Repp ..... A47J 19/00 210/740
2008/0078201 A1 * 4/2008 Olefson ..... F25D 25/02 312/351
2021/0227787 A1 * 7/2021 Friedgood ..... A45C 13/02

FOREIGN PATENT DOCUMENTS

CN 104990330 A * 10/2015
CN 206540363 U 10/2017
CN 208365930 U 1/2019
(Continued)

OTHER PUBLICATIONS

CN-104990330-A Translation (Year: 2015).*

*Primary Examiner* — David J Teitelbaum
(74) *Attorney, Agent, or Firm* — Dority & Manning, P.A.

(57) ABSTRACT

A refrigerator appliance includes a cabinet. The cabinet defines a food storage chamber therein. A door is rotatably mounted to the cabinet. The refrigerator appliance also includes a food storage unit. The food storage unit includes a rigid structural frame surrounding a flexible element. The flexible element is deformable and movable relative to the rigid structural frame.

6 Claims, 20 Drawing Sheets

(56) References Cited

FOREIGN PATENT DOCUMENTS

| | | | |
|---|---|---|---|
| CN | 107606863 | B | 3/2020 |
| DE | 4304502 | A1 | 8/1994 |
| DE | 60225636 | T2 | 4/2009 |
| DE | 10208058 | B4 | 10/2018 |
| KR | 100886123 | B1 | 2/2009 |

* cited by examiner

REFRIGERATOR APPLIANCE WITH IMPROVED STORAGE

FIELD OF THE INVENTION

The present subject matter relates generally to refrigerator appliances, and more particularly to refrigerator appliances having flexible storage features.

BACKGROUND OF THE INVENTION

Refrigerator appliances generally include a cabinet that defines a chilled chamber. A wide variety of food items may be stored within the chilled chamber. The low temperature of the chilled chamber relative to ambient atmosphere assists with increasing a shelf life of the food items stored within the chilled chamber.

Various food storage units, such as bins, shelves, and drawers are typically provided in the chilled chamber of the refrigerator appliance in order to promote organization of and access to the food items therein. Such storage units are commonly arranged at set distances with little, if any, freedom to adjust the positions of the storage units within the limited volume available in the chilled chamber.

Accordingly, a refrigerator with features for improved storage of food items therein, such as quickly and easily adjusting the capacity of a food storage unit to accommodate, e.g., taller than usual food items, would be useful.

BRIEF DESCRIPTION OF THE INVENTION

Aspects and advantages of the invention will be set forth in part in the following description, or may be apparent from the description, or may be learned through practice of the invention.

In an exemplary embodiment, a refrigerator appliance is provided. The refrigerator appliance defines a vertical direction, a lateral direction, and a transverse direction. The vertical, lateral, and transverse directions are mutually perpendicular. The refrigerator appliance includes a cabinet defining a food storage chamber. The refrigerator appliance also includes a food storage unit. The food storage unit includes a rigid structural frame surrounding a flexible element. The flexible element is deformable and movable relative to the rigid structural frame.

In another exemplary embodiment, a refrigerator appliance is provided. The refrigerator appliance includes a cabinet defining a food storage chamber. The refrigerator appliance also includes a food storage unit. The food storage unit includes a rigid structural frame surrounding a flexible element. The flexible element is deformable and movable relative to the rigid structural frame.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
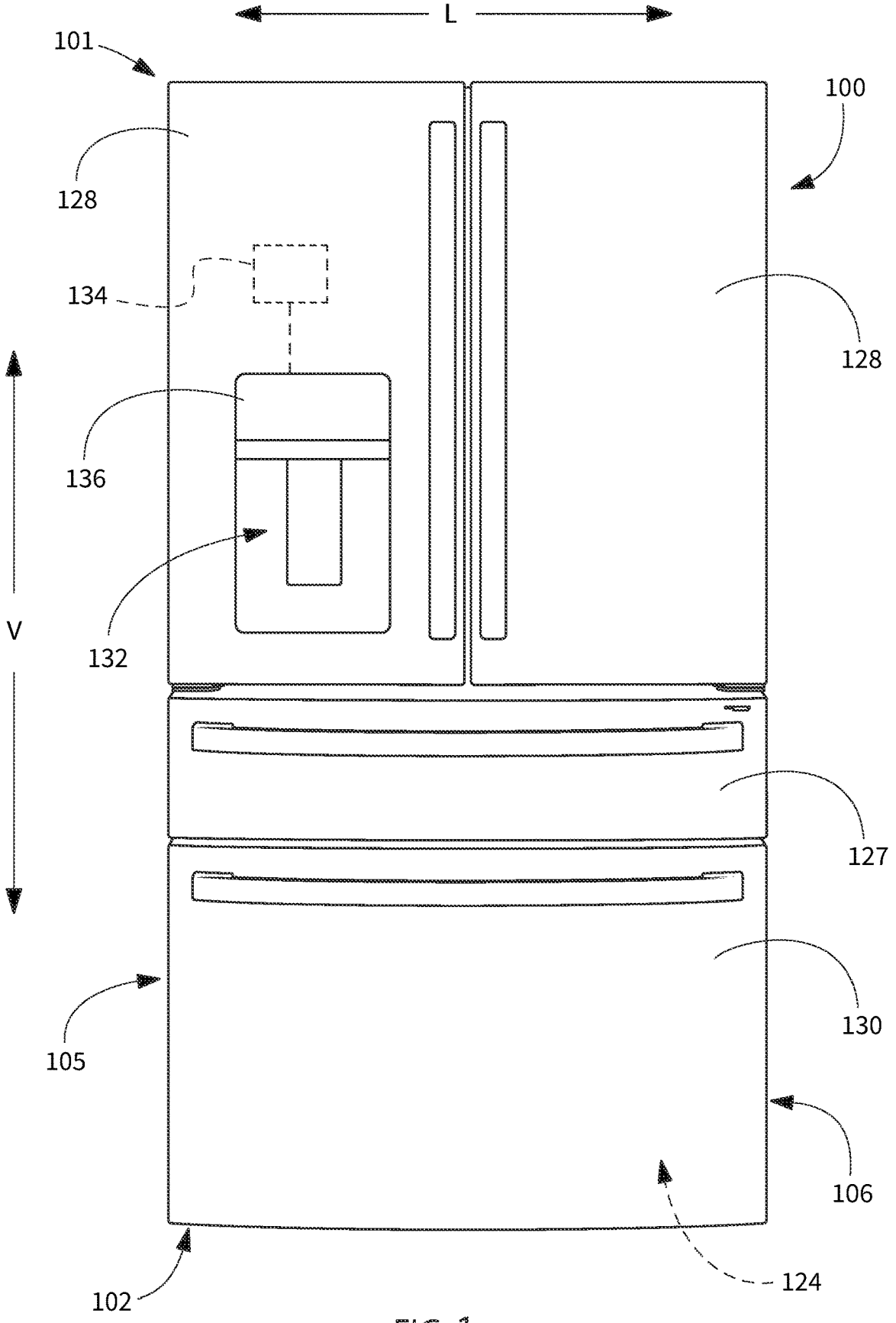
FIG. 1 provides a front view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
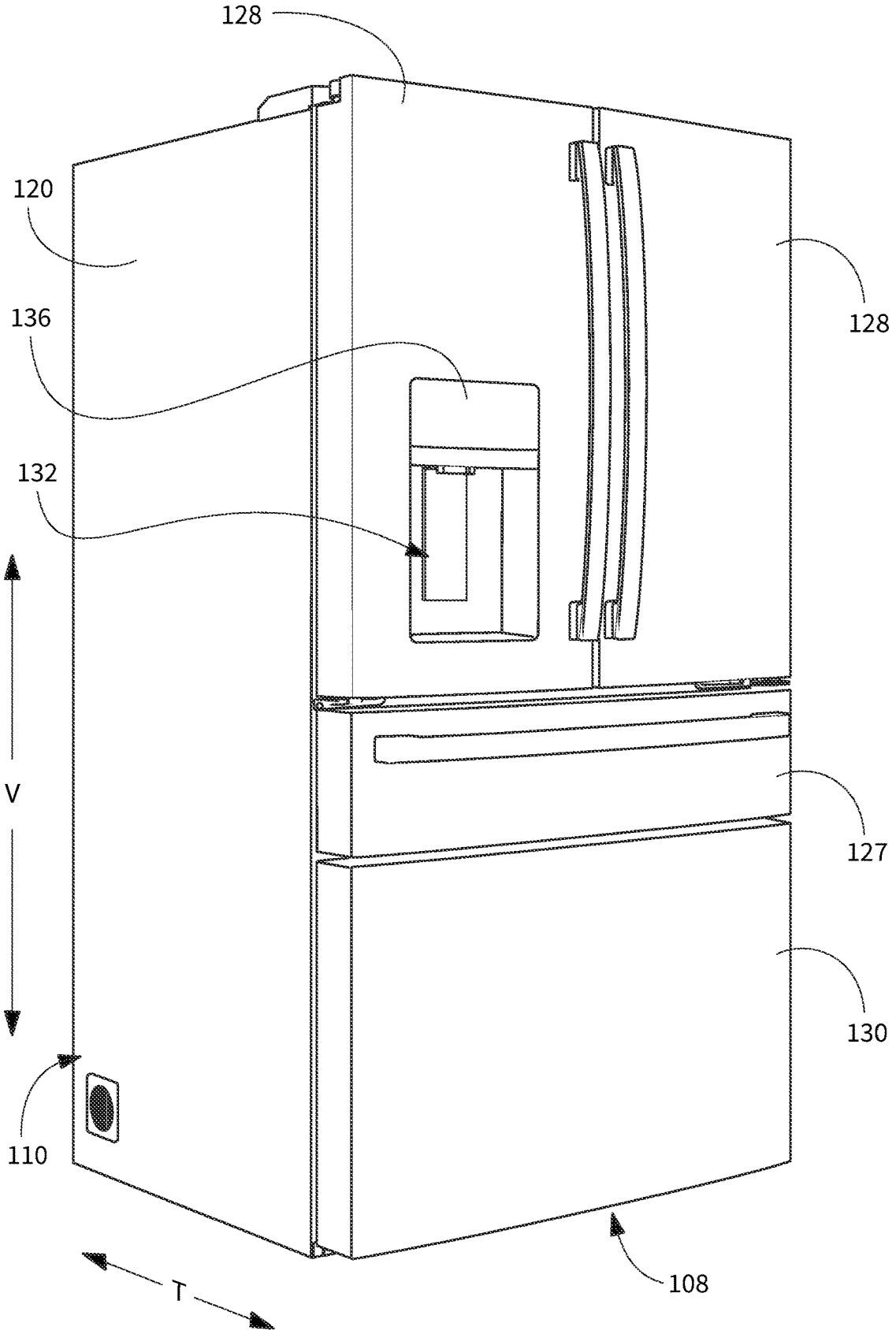
FIG. 2 provides a perspective view of the refrigerator appliance of FIG. 1.
Figure 3:
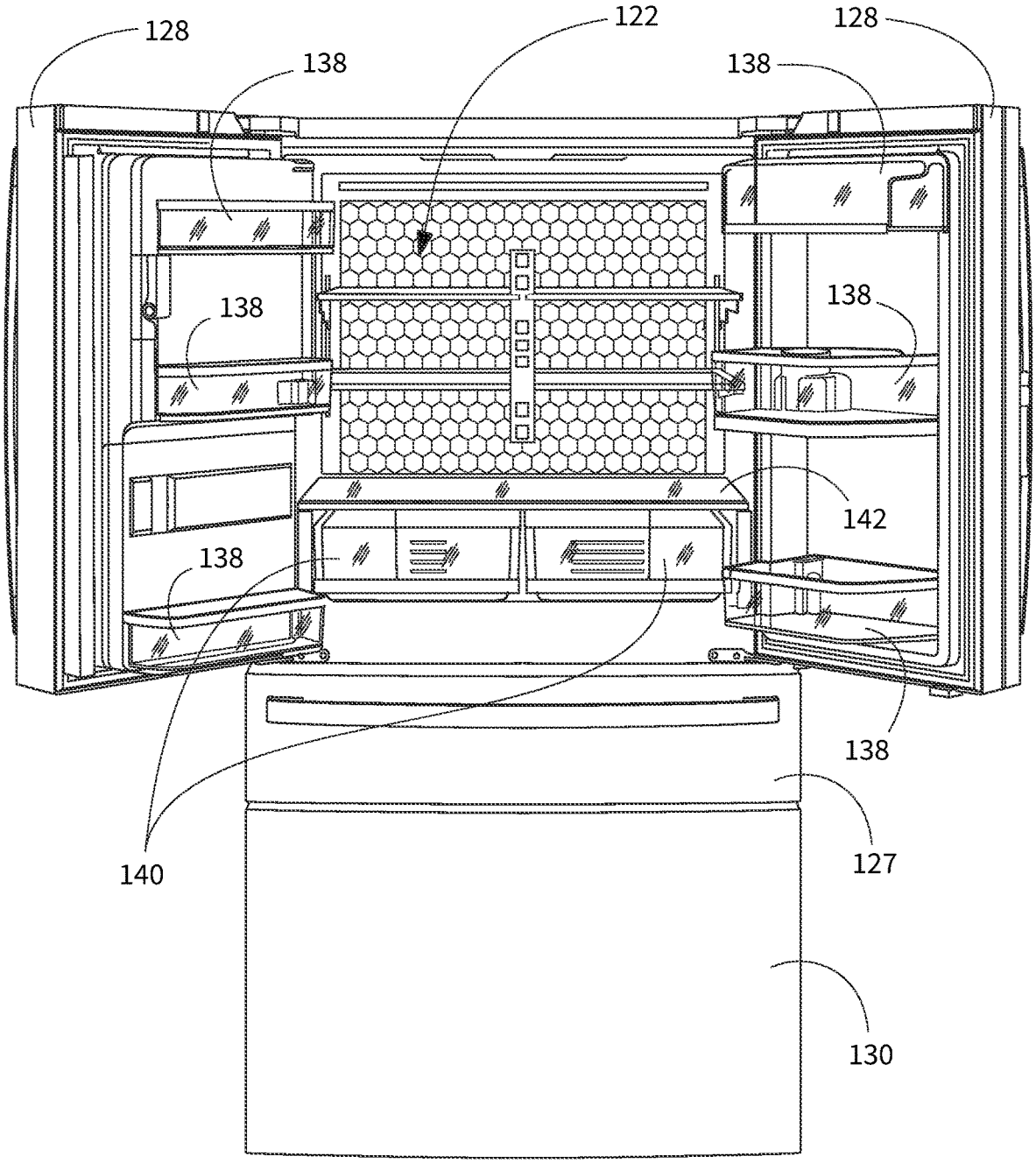
FIG. 3 provides a front view of the refrigerator appliance of FIG. 1 with doors thereof in an open position.
Figure 4:
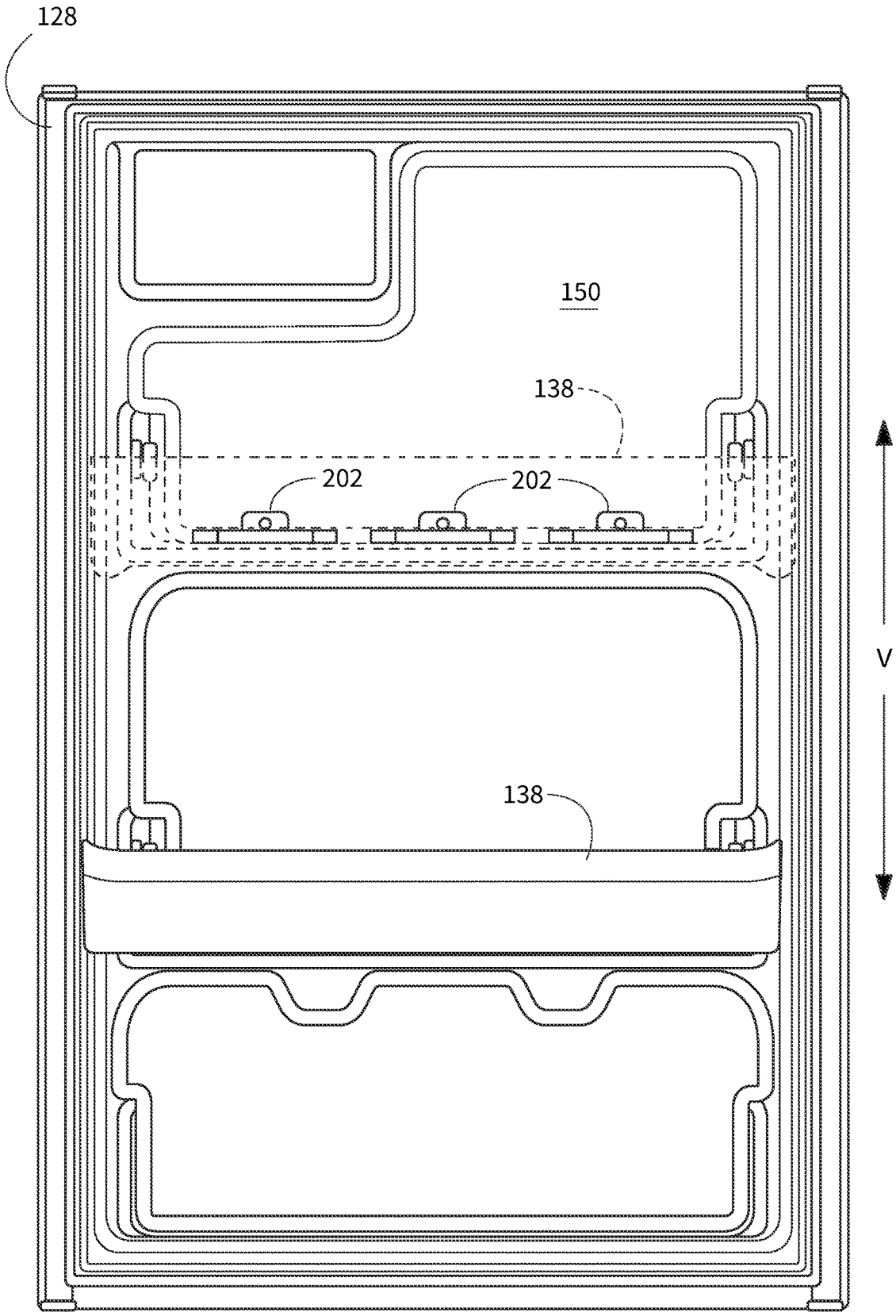
FIG. 4 provides an elevation view of an inner side of door of a refrigerator appliance according to one or more exemplary embodiments of the present subject matter.
Figure 5:
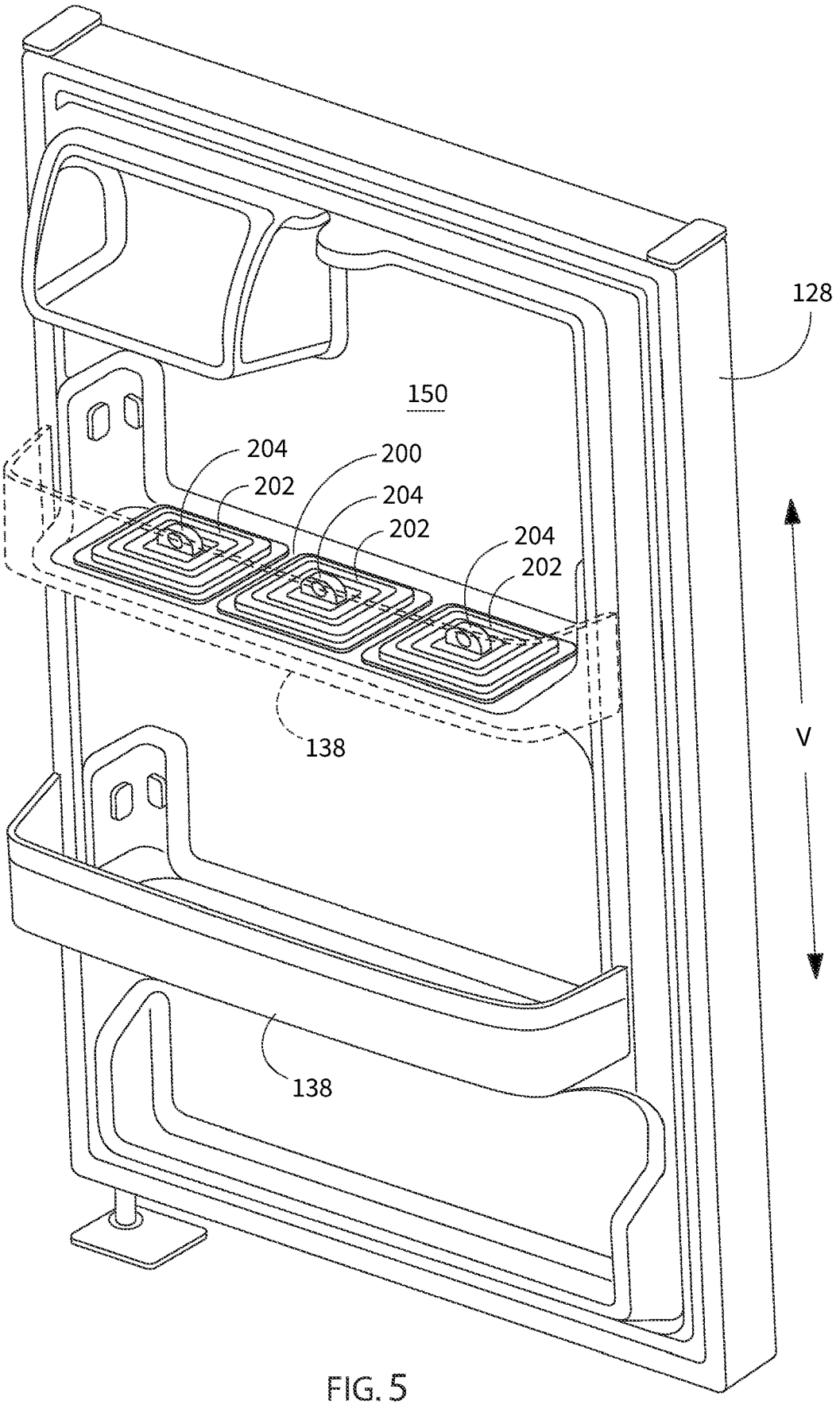
FIG. 5 provides a perspective view of the door of FIG. 4.

FIG. 1 is a front view of an exemplary embodiment of a refrigerator appliance 100. FIG. 2 is a perspective view of the refrigerator appliance 100. FIG. 3 is a front view of the refrigerator appliance 100 with fresh food doors 128 thereof in an open position. Refrigerator appliance 100 extends between a top 101 and a bottom 102 along a vertical direction V. Refrigerator appliance 100 also extends between a first side 105 and a second side 106 along a lateral direction L. As shown in FIG. 2, a transverse direction T may additionally be defined perpendicular to the vertical and lateral directions V and L. Refrigerator appliance 100 extends along the transverse direction T between a front portion 108 and a back portion 110.

Refrigerator appliance 100 includes a cabinet or housing 120 defining an upper fresh food chamber 122 (FIG. 3) and a lower freezer chamber or frozen food storage chamber 124 arranged below the fresh food chamber 122 along the vertical direction V. In some embodiments, an auxiliary food storage chamber (not shown) may be positioned between the fresh food storage chamber 122 and the frozen food storage chamber 124, e.g., along the vertical direction V. Because the frozen food storage chamber 124 is positioned below the fresh food storage chamber 122, refrigerator appliance 100 is generally referred to as a bottom mount refrigerator. In the exemplary embodiment, housing 120 also defines a mechanical compartment (not shown) for receipt of a sealed cooling system (not shown). Using the teachings disclosed herein, one of skill in the art will understand that the present invention can be used with other types of refrigerators (e.g., side-by-sides) or a freezer appliance as well. Consequently, the description set forth herein is for illustrative purposes only and is not intended to limit the invention in any aspect.

Refrigerator doors 128 are each rotatably hinged to an edge of housing 120 for accessing fresh food chamber 122. Each door 128 is movable, e.g., rotatable, between a closed position wherein the door 128 abuts the cabinet 120 to sealingly enclose the food storage chamber 122 and an open position which permits access to the food storage chamber 122. It should be noted that while two doors 128 in a "French door" configuration are illustrated, any suitable arrangement of doors utilizing one, two or more doors is within the scope and spirit of the present disclosure. A freezer door 130 is arranged below refrigerator doors 128 for accessing freezer chamber 124. In the exemplary embodiment, freezer door 130 is coupled to a freezer drawer (not shown) slidably mounted within freezer chamber 124. An auxiliary door 127 may be coupled to an auxiliary drawer (not shown) which is slidably mounted within the auxiliary chamber (not shown).

Operation of the refrigerator appliance 100 can be regulated by a controller 134 that is operatively coupled to a user interface panel 136. User interface panel 136 provides selections for user manipulation of the operation of refrigerator appliance 100 to modify environmental conditions therein, such as temperature selections, etc. In some embodiments, user interface panel 136 may be proximate a dispenser assembly 132. Panel 136 provides selections for user manipulation of the operation of refrigerator appliance 100 such as, e.g., temperature selections, selection of automatic or manual override humidity control (as described in more detail below), etc. In response to user manipulation of the user interface panel 136, the controller 134 operates various components of the refrigerator appliance 100. Operation of the refrigerator appliance 100 can be regulated by the controller 134, e.g., controller 134 may regulate operation of various components of the refrigerator appliance 100 in response to programming and/or user manipulation of the user interface panel 136.

The controller 134 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor. It should be noted that controllers 134 as disclosed herein are capable of and may be operable to perform any methods and associated method steps as disclosed herein.

The controller 134 may be positioned in a variety of locations throughout refrigerator appliance 100. In the illustrated embodiment, the controller 134 may be located within the door 128. In such an embodiment, input/output ("I/O") signals may be routed between the controller and various operational components of refrigerator appliance 100. In one embodiment, the user interface panel 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. For example, the user interface 136 may include a touchscreen providing both input and display functionality. The user interface 136 may be in communication with the controller via one or more signal lines or shared communication busses.

As may be seen in FIG. 3, a plurality of food storage units, such as bins 138, shelves 142, and drawers 140 are disposed within the fresh food storage chamber 122. As will be described in more detail below, one or more of the food storage units may include a rigid structural frame and a flexible element positioned within and movable relative to the rigid structural frame. It is to be understood that the terms "rigid" and "flexible" are used herein relative to each other, e.g., the rigid structural frame is more rigid than the flexible element and the flexible element is more flexible than the rigid structural frame. For example, in some embodiments, the rigid structural frame is configured to structurally support a food item and the flexible element is configured to deform such that the flexible element moves relative to the rigid structural frame in order to accommodate the food item.

Using the teachings disclosed herein, one of skill in the art will understand that the present subject matter can be used with other types of refrigerators such as a refrigerator/freezer combination, side-by-side, bottom mount, compact, and any other style or model of refrigerator appliance. Accordingly, other configurations of refrigerator appliance 100 could be provided, it being understood that the configurations shown in the accompanying FIGS. and the description set forth herein are by way of example for illustrative purposes only.

As mentioned above, embodiments of the present disclosure include a food storage unit positioned inside a refrigerator appliance, e.g., within the fresh food storage chamber, the food storage unit includes a rigid structural frame surrounding a flexible element. As will be described in more detail and in the context of various example embodiments, e.g., such as the exemplary embodiments illustrated in FIGS. 4 through 23, the flexible element may be deformable and movable relative to the rigid structural frame. For example, the flexible element may be configured to deform such that a portion of the flexible element moves away from the rigid frame. Deform as used herein includes one or more changes in shape including, e.g., bend, unfold, stretch, and/or expand, as well as other possible changes in shape, including combinations of one or more such changes. Such flexibility may advantageously provide multiple storage configurations, such as to accommodate larger, e.g., taller, food items, without requiring removal and reinstallation of the food storage unit, e.g., shelf or bin.

Referring now to FIGS. 4 through 9, in some embodiments the food storage unit may be a bin 138 mounted on an interior surface 150 of one of the refrigerator doors 128. In such embodiments, the rigid structural frame may be a floor 200 of the bin 138 that is oriented generally perpendicular to the vertical direction V, and the flexible element may be a telescopic container 202. It should be understood that the floor 200 is oriented generally perpendicular to the vertical direction V in that the major dimensions, e.g., the two largest dimensions, of the floor 200 are each oriented perpendicular to the vertical direction V. For example, when the door 128 is in the closed position, the floor 200 may define a width generally along the lateral direction L and a depth generally along the transverse direction T, where each of the width and the depth of the floor 200 is several times greater, e.g., at least three times greater, than a height or thickness of the floor 200 that is defined generally along the vertical direction V. The telescopic container 202 may be deformable generally perpendicularly to the floor 200, e.g., up and/or down generally along the vertical direction V.

Figure 6:
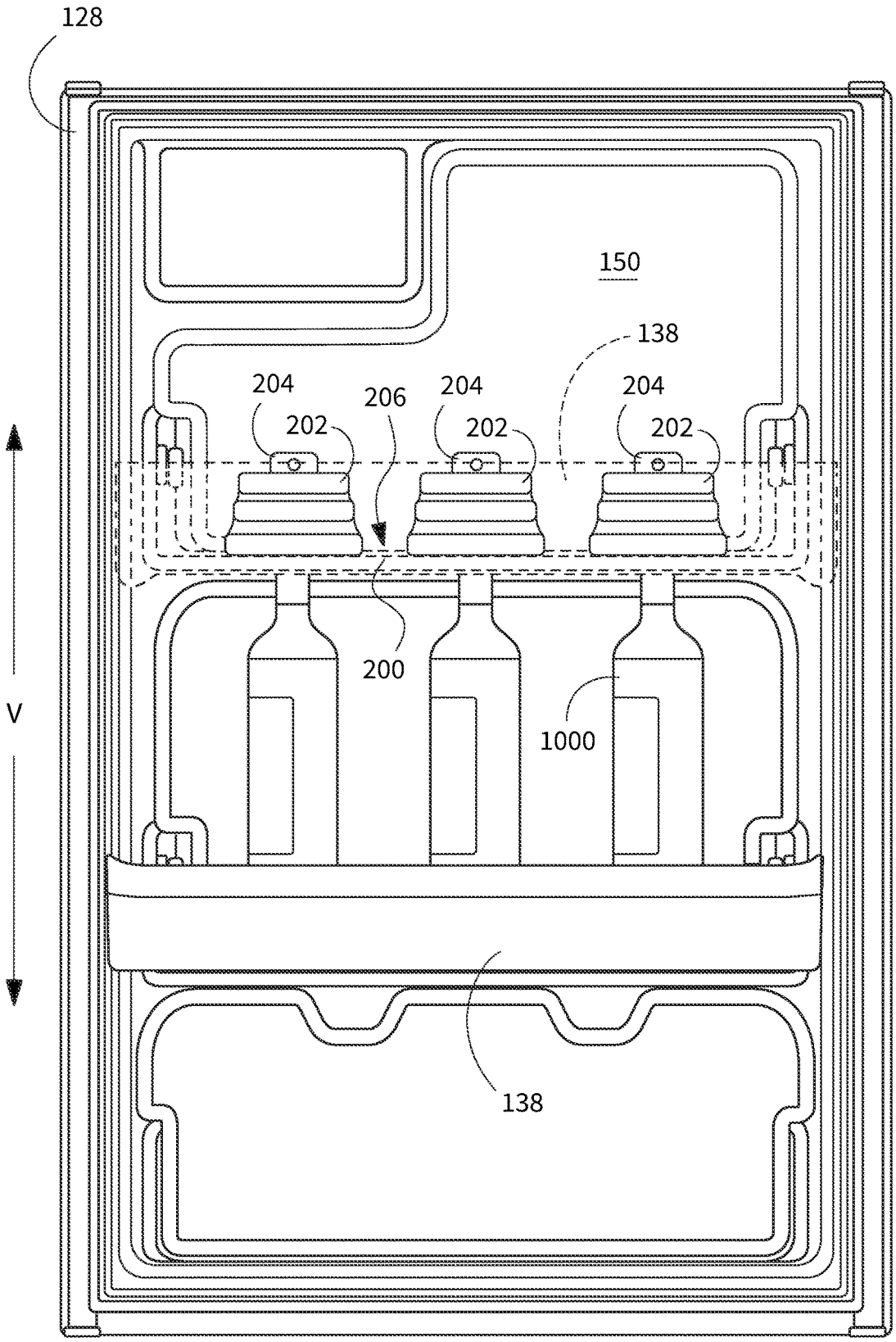
FIG. 6 provides another elevation view of the door of FIG. 4, with a plurality of flexible elements in an expanded position.
Figure 7:
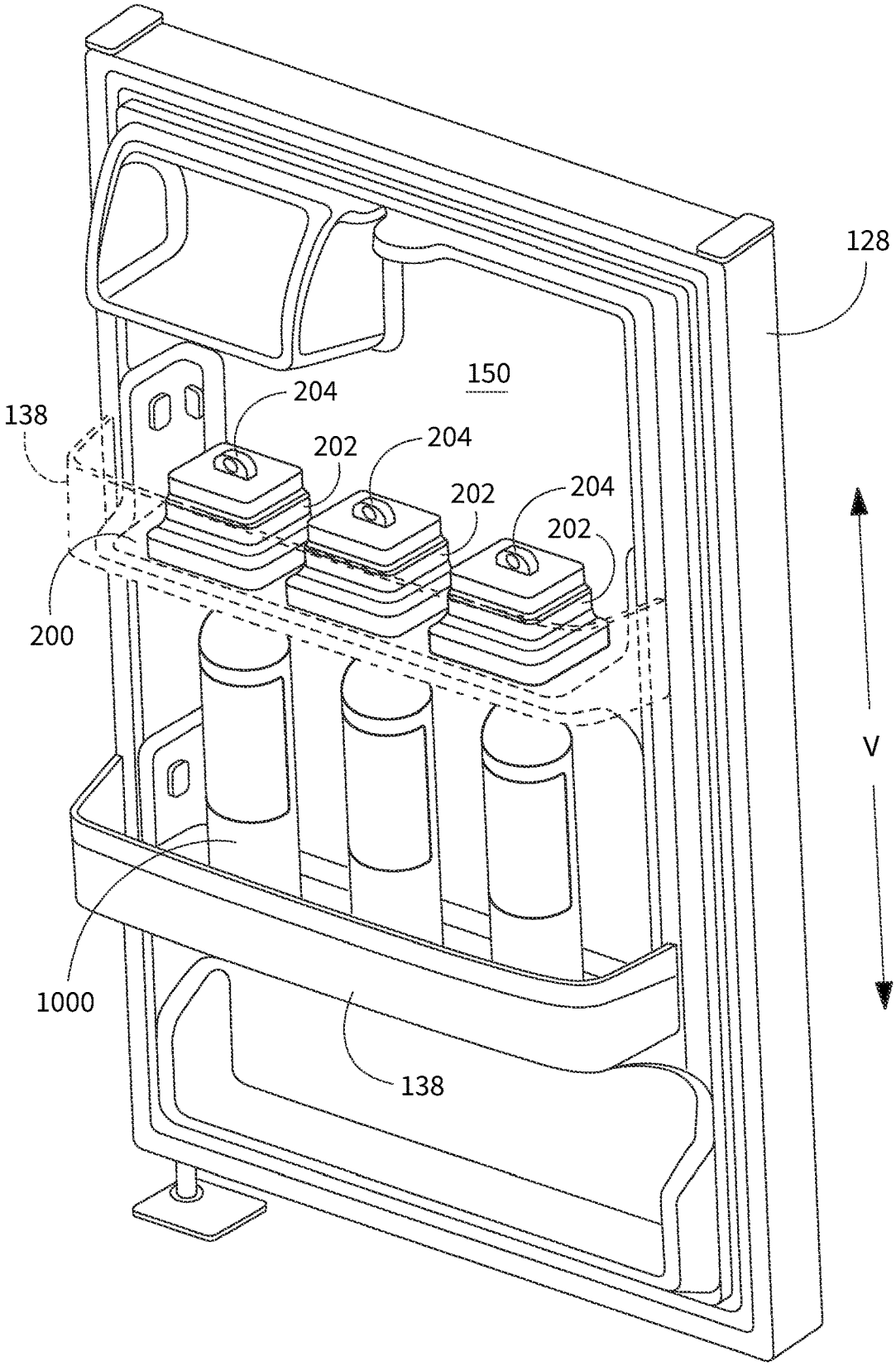
FIG. 7 provides a perspective view of the door of FIG. 6.

For example, in some embodiments, e.g., as illustrated in FIGS. 4 through 7, the telescopic container 202 may be deformable, e.g., extendable, upwards along the vertical direction V away from the floor 200. For example, the telescopic container 202 may be deformable to an expanded position, e.g., as illustrated in FIGS. 6 and 7, where the telescopic container 202 extends above the floor 200. Thus, when the food storage unit is an upper bin 138 with a second bin 138 (or shelf, etc.) positioned therebelow, one or more taller food items, such as food items 1000 illustrated in FIGS. 6 and 7, may be stored on the lower storage unit, e.g., lower bin 138, and the flexible element(s) 202 may be deformed to the expanded position, e.g., whereby the flexible element(s) 202 move(s) away from and above the floor 200, to accommodate the taller food items 1000 therebelow.

Figure 8:
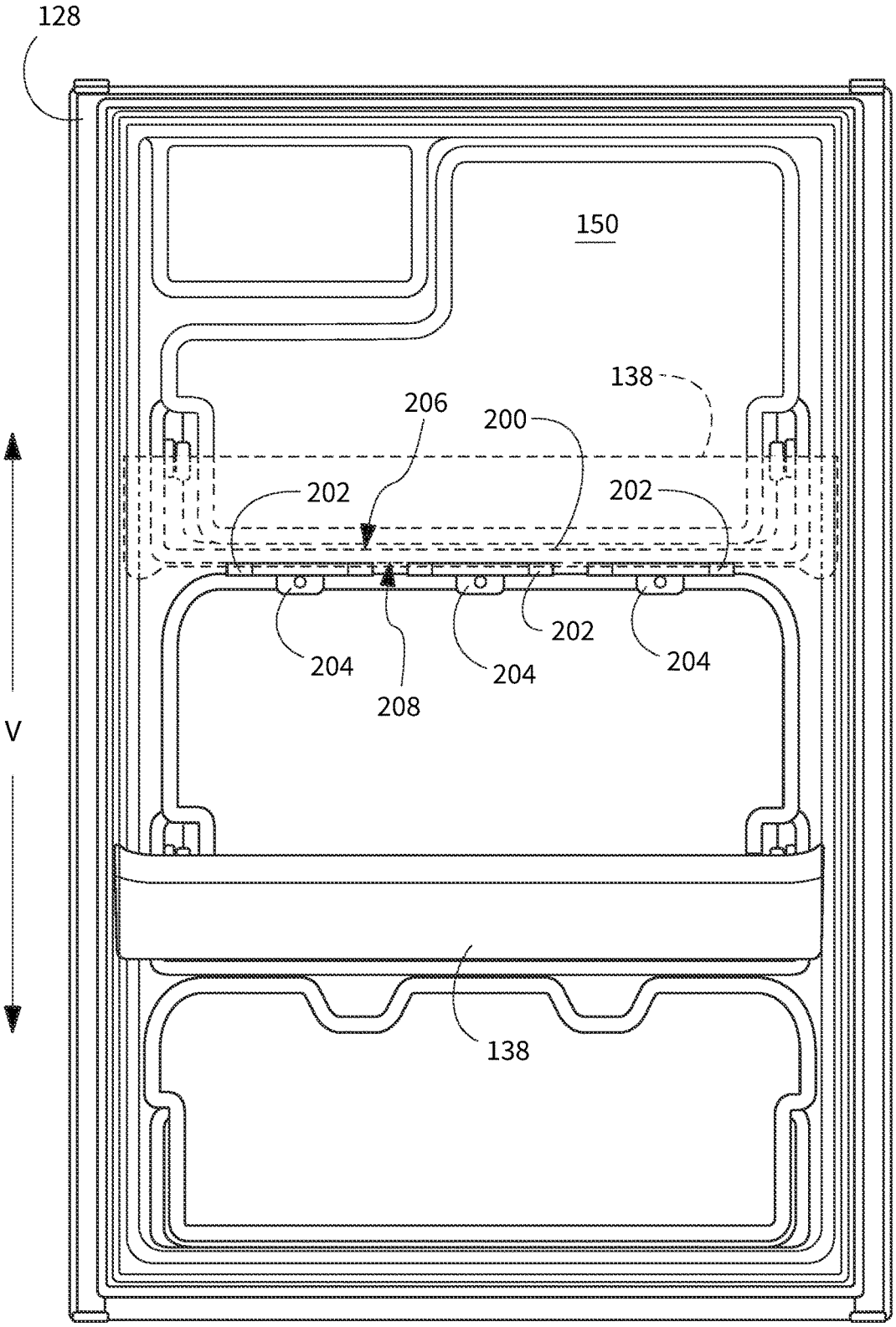
FIG. 8 provides an elevation view of an inner side of door of a refrigerator appliance according to one or more exemplary embodiments of the present subject matter.
Figure 9:
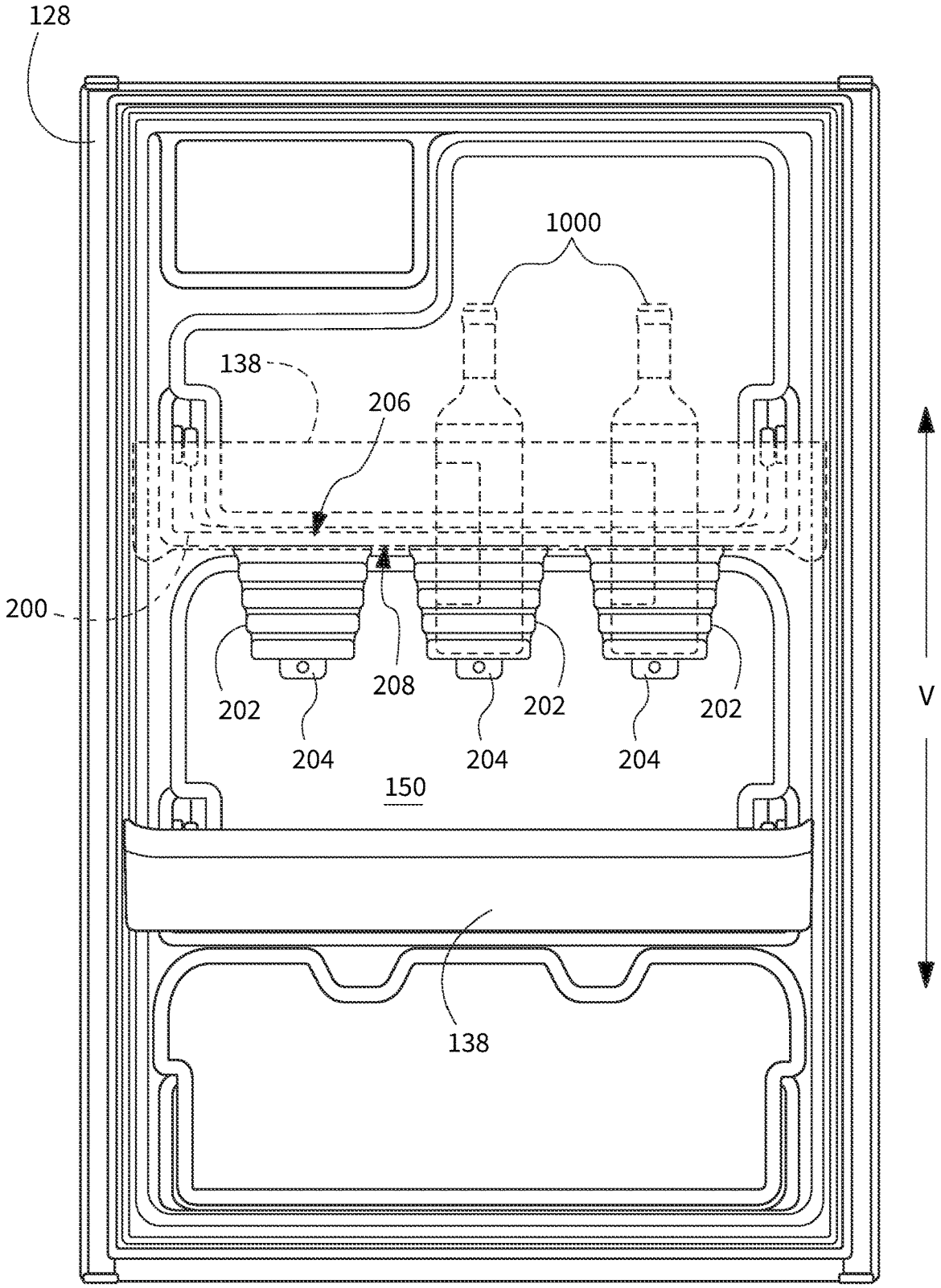
FIG. 9 provides another elevation view of the door of FIG. 8, with a plurality of flexible elements in an expanded position.

In additional embodiments, the flexible element, e.g., telescopic container 202, may be deformable downwards along the vertical direction V, e.g., as illustrated in FIGS. 8 and 9. In such embodiments, the telescopic container 202 may thus be configured to receive a food item 1000 therein, whereby the food item 1000 is accommodated within a vertical space above the bin 138. For example, where the food item 1000 is taller, e.g., has a height larger than the vertical space above the bin 138, a portion of the height of the taller food item 1000 may be positioned within the downward extended telescopic container 202 and the remainder of the height of the taller food item 1000 may be positioned within and above bin 138.

Also, it is to be understood that the telescopic container 202 may be deformable in both direction, e.g., two opposing directions such as up and down. For example, the telescopic container 202 in FIGS. 4 through 7 may also be deformable downward along the vertical direction V.

In some embodiments, for example, as illustrated in FIGS. 10 through 15, the food storage unit may be a bin 138 mounted on the interior surface 150 of the door 128. Thus, as a result of the bin 138 being mounted on the interior surface 150 of the door 128, the bin 138 may be positioned within the food storage chamber 122 when the door 128 is in the closed position. In such embodiments, the rigid structural frame may be a wall 210 of the bin 138. The wall 210 maybe oriented generally along the vertical direction V, e.g., one of the major dimensions, e.g., one of the two largest dimensions, of the floor 200 may be oriented generally along the vertical direction V. For example, the wall 210 may define a height generally along the vertical direction V, and the height of the wall 210 may be the largest dimension or one of the two largest dimensions of the wall 210. In at least some embodiments, the wall 210 may be spaced apart from and generally parallel to the interior surface 150 of the door 128, e.g., the two major dimensions of the wall 210 may define a surface or plane that is generally parallel to the interior surface 150 of the door 128, where "generally parallel" includes within ten degrees of parallel and encompasses linear and/or curved surfaces of one or both the interior surface 150 and the surface define by the wall 210 as described.

Figure 10:
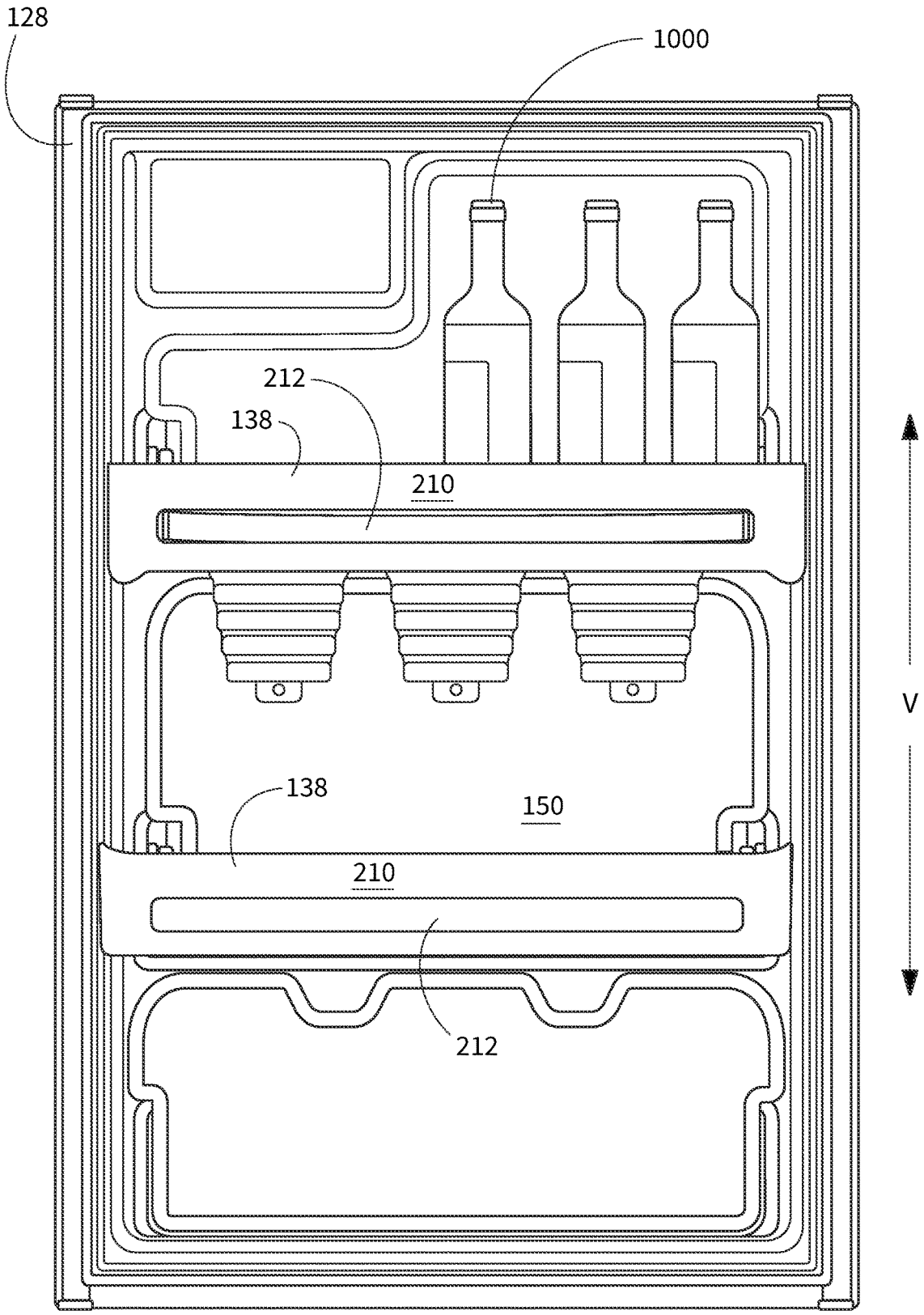
FIG. 10 provides an elevation view of an inner side of door of a refrigerator appliance with a flexible element thereof in a bowed position according to one or more exemplary embodiments of the present subject matter.
Figure 11:
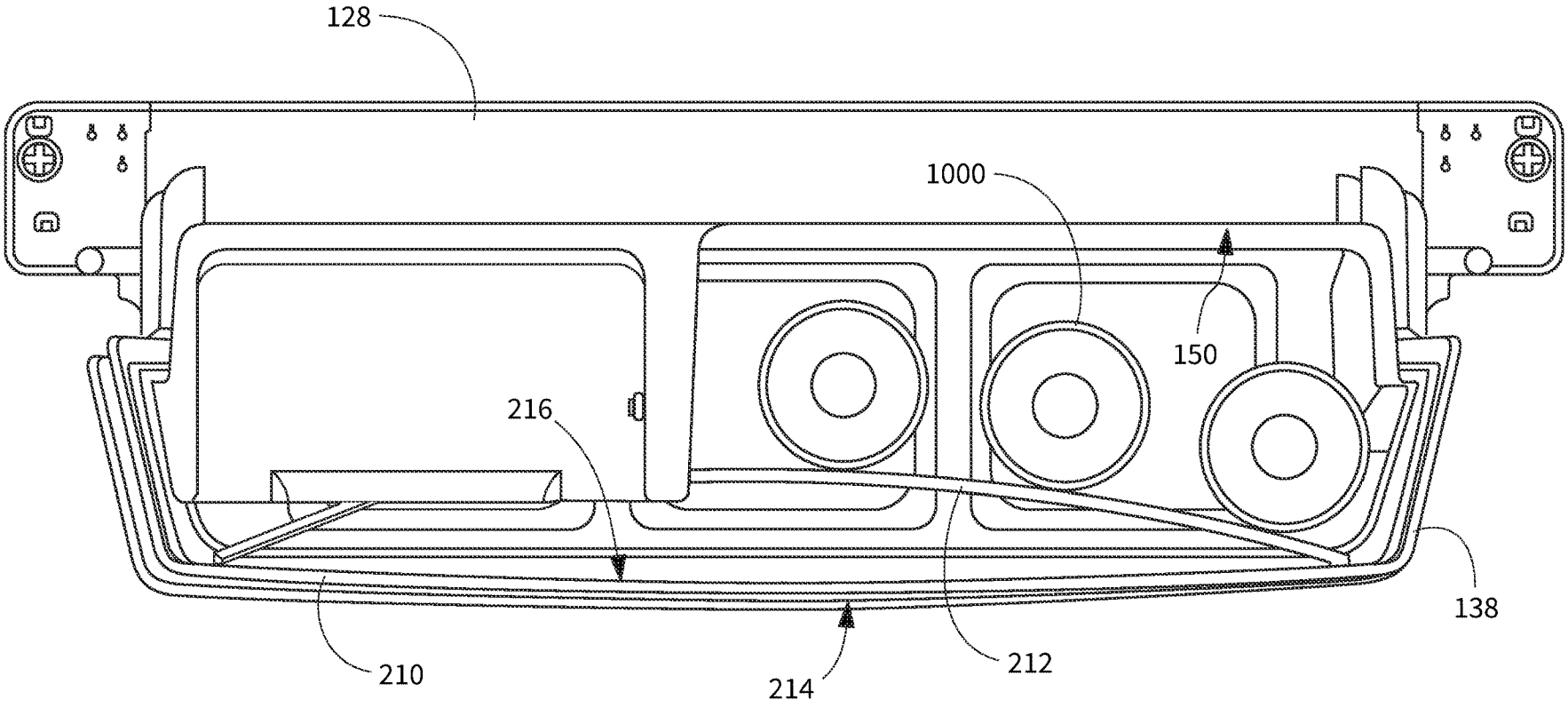
FIG. 11 provides a top-down view of the door of FIG. 10.
Figure 12:
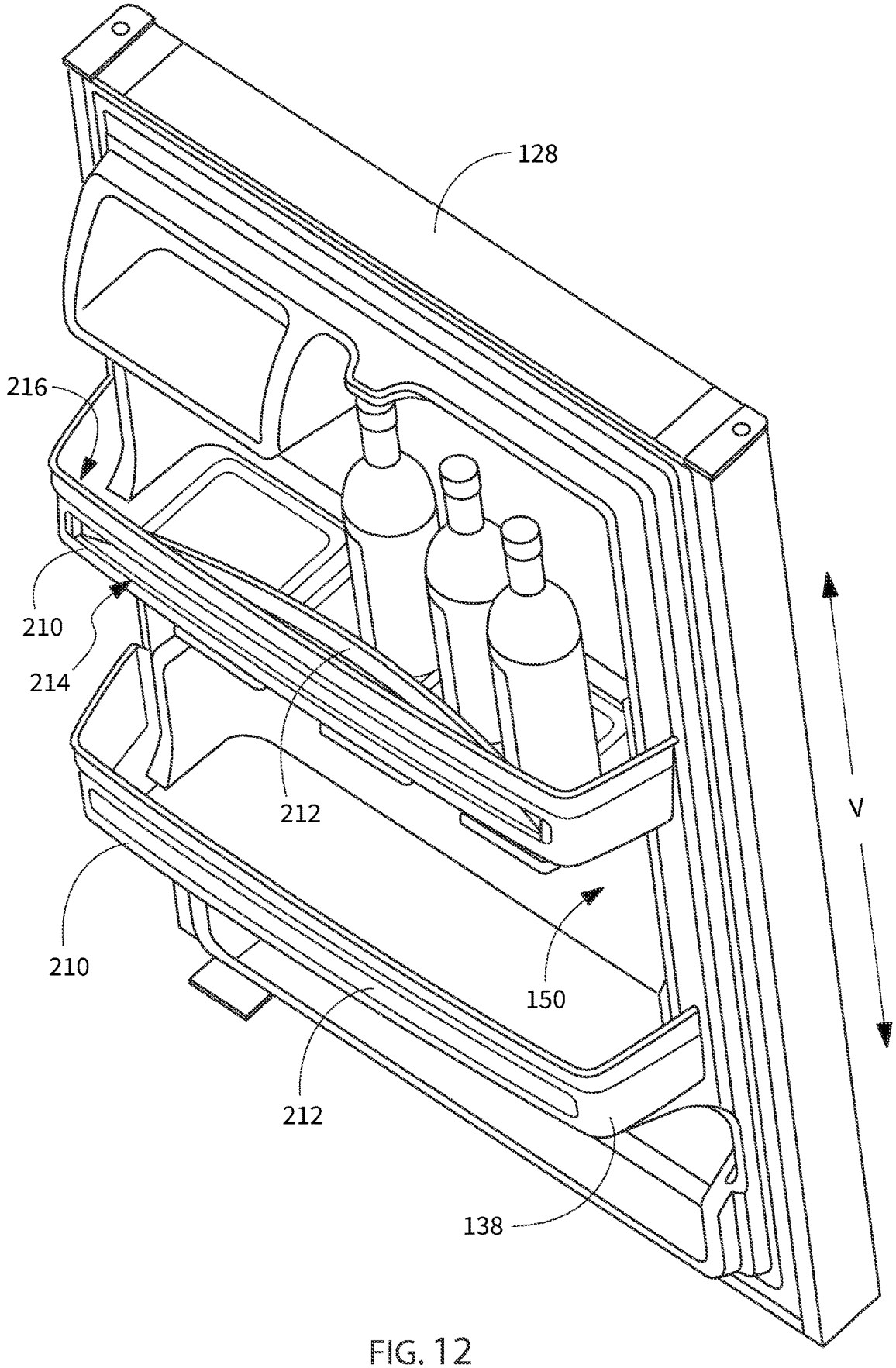
FIG. 12 provides a perspective view of the door of FIG. 10.
Figure 13:
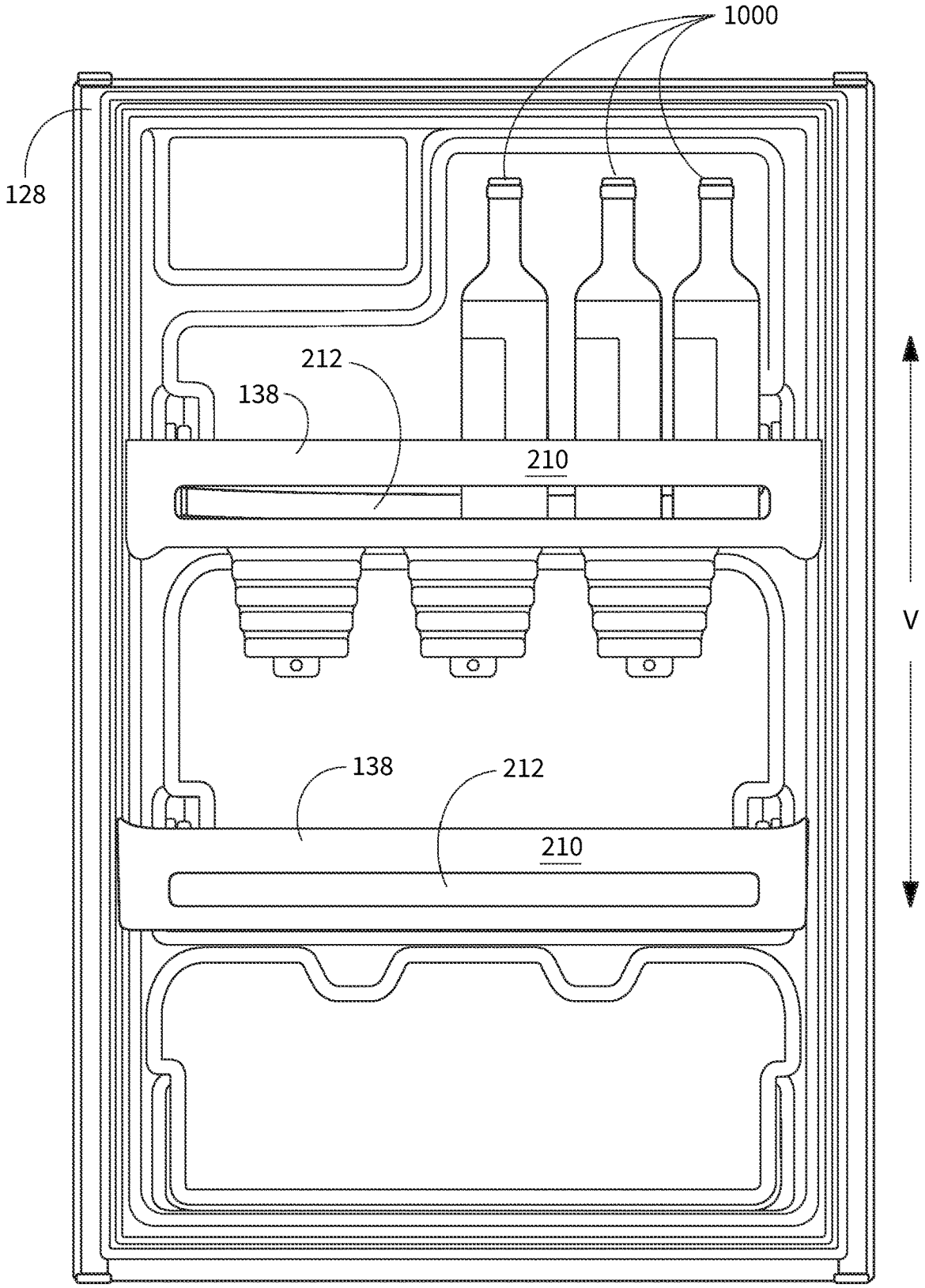
FIG. 13 provides an elevation view of an inner side of door of a refrigerator appliance with a flexible element thereof in a bowed position according to one or more exemplary embodiments of the present subject matter.
Figure 14:
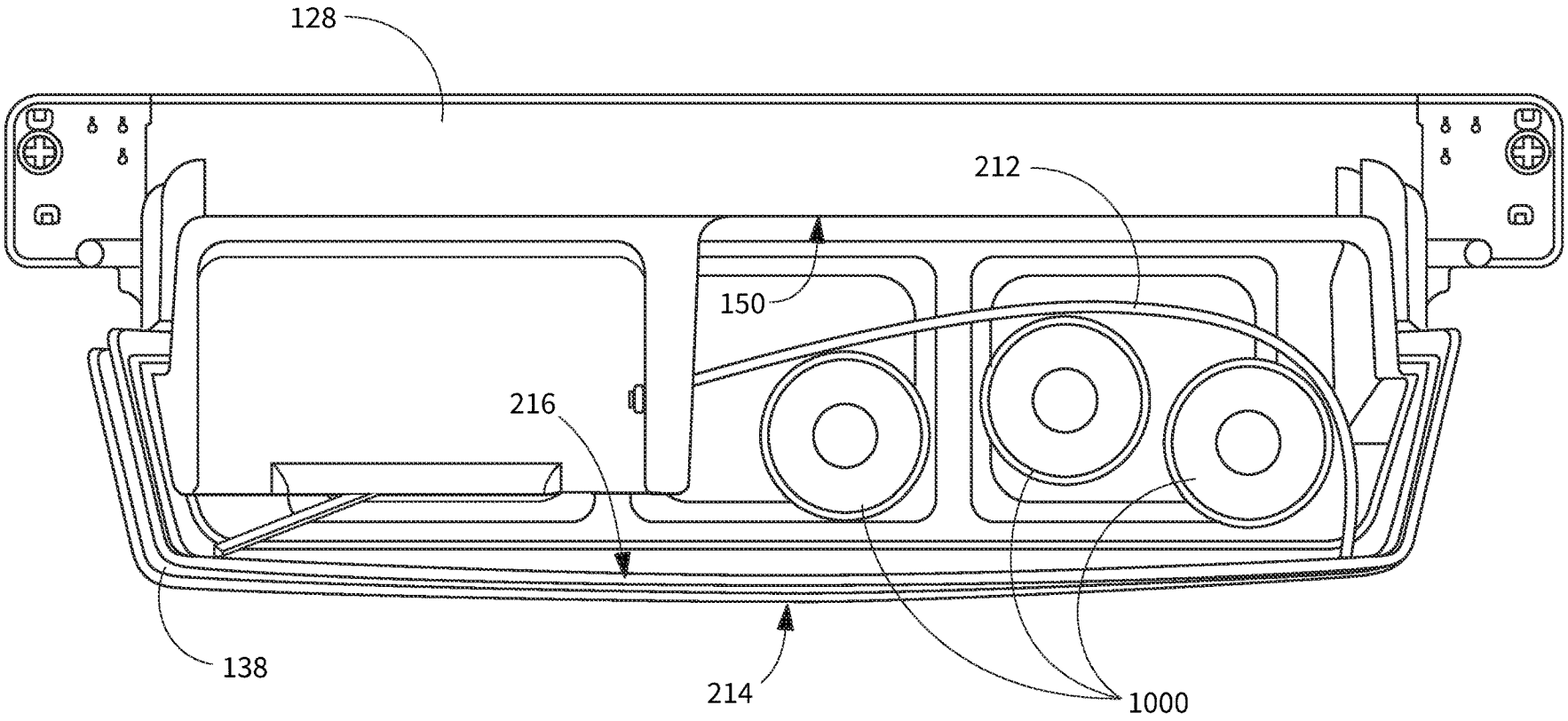
FIG. 14 provides a top-down view of the door of FIG. 13.
Figure 15:
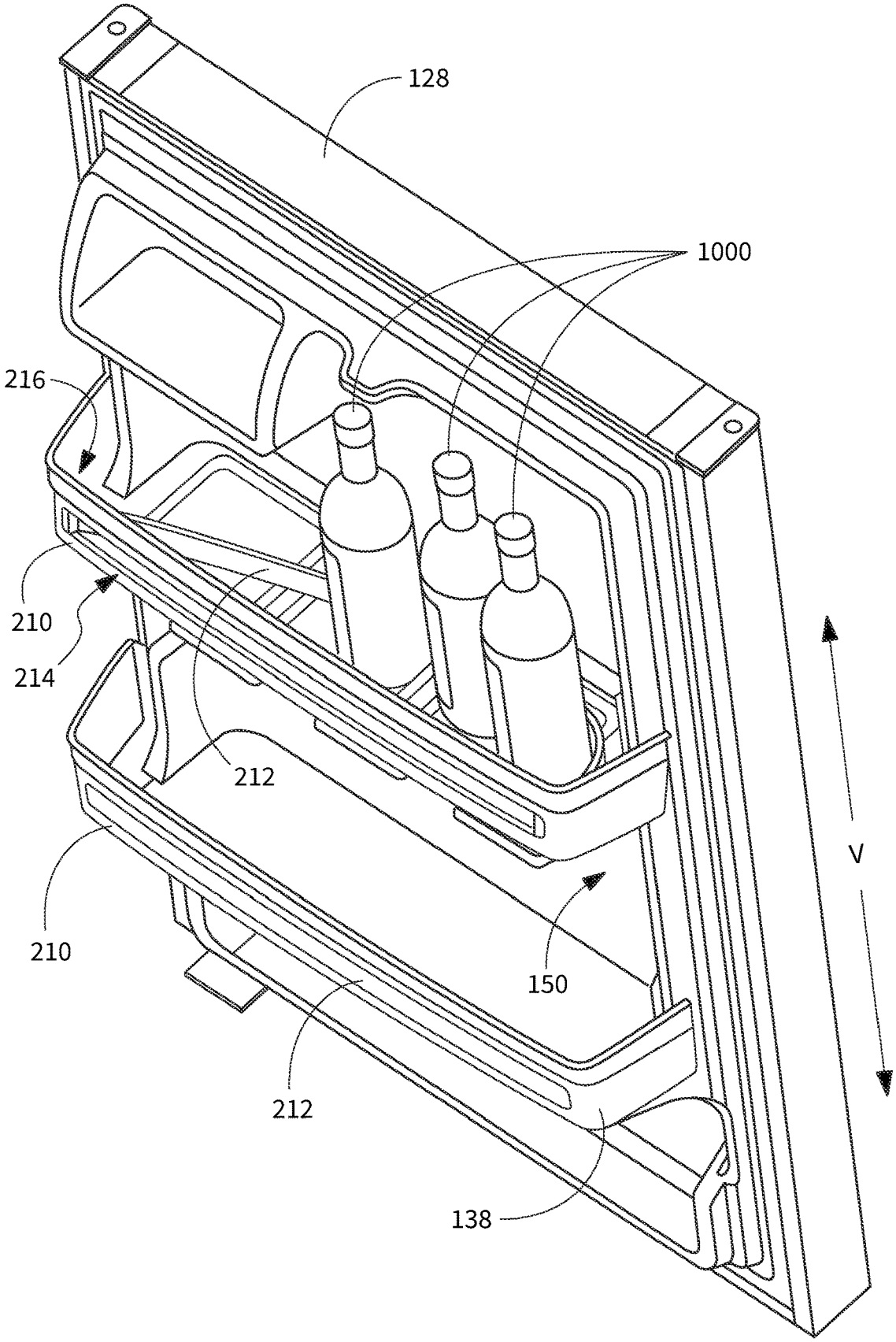
FIG. 15 provides a perspective view of the door of FIG. 13.

In such embodiments, the flexible element may be a band 212 that is deformable generally perpendicularly to the wall 210. For example, the band 212 may be used as a bumper to constrain food items 1000 between the wall 210 and the interior surface 150 of the door 128, e.g., as illustrated in FIGS. 10 through 12. As another example, the band 212 may also be used as a holding strap to secure the food items 1000 within the bin 138, such as between the band 212 and the wall 210. The band 212 may be mounted, e.g., fixed to the wall 210 at opposite ends of the band 212, while the band 212 is free to move between the fixed ends, e.g., a middle portion of the band 212 between the fixed end is deformable and movable. Thus, the band 212 may deform, e.g., bend and/or stretch, along the middle portion of the band 212 away from the wall 210 and towards the interior surface 150 of the door 128, such as along a direction that is generally parallel to the vertical direction V, e.g., along the transverse direction T when the door 128 is in the closed position.

Turning now to FIGS. 16 through 23, in some embodiments the food storage unit may be a shelf 142 mounted in the food storage chamber 122. In such embodiments, the rigid structural frame may be a platform 220 of the shelf 142 that is oriented generally perpendicular to the vertical direction V, e.g., similarly to the floor 200 of the bin 138 as described above. In such embodiments, the flexible element may be a telescopic cap 222 that is deformable generally perpendicularly to the platform 220.

Figure 16:
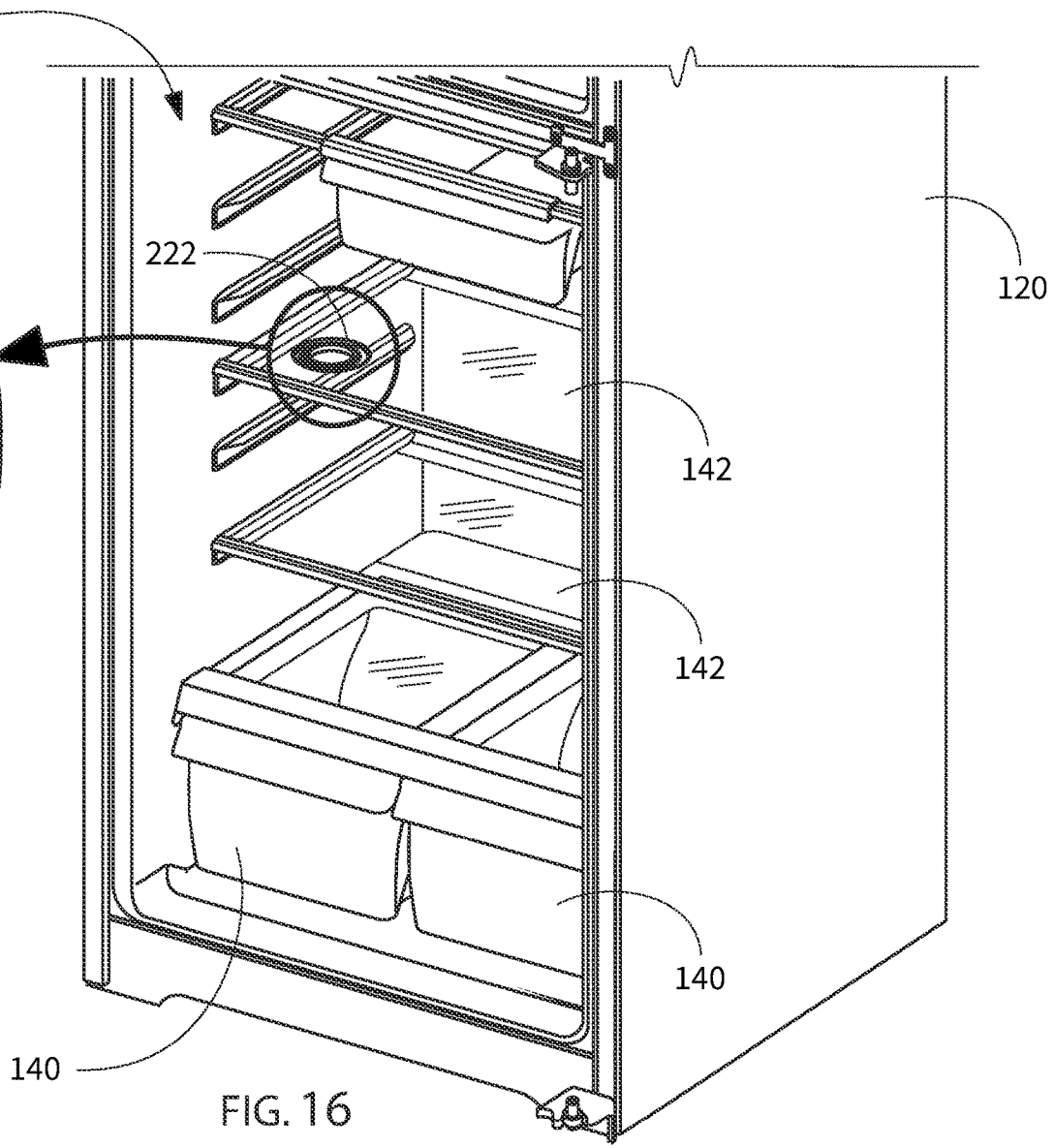
FIG. 16 provides a perspective view of a food storage chamber defined in a cabinet of a refrigerator appliance with a flexible element in a collapsed position according to one or more exemplary embodiments of the present subject matter.
Figure 17:
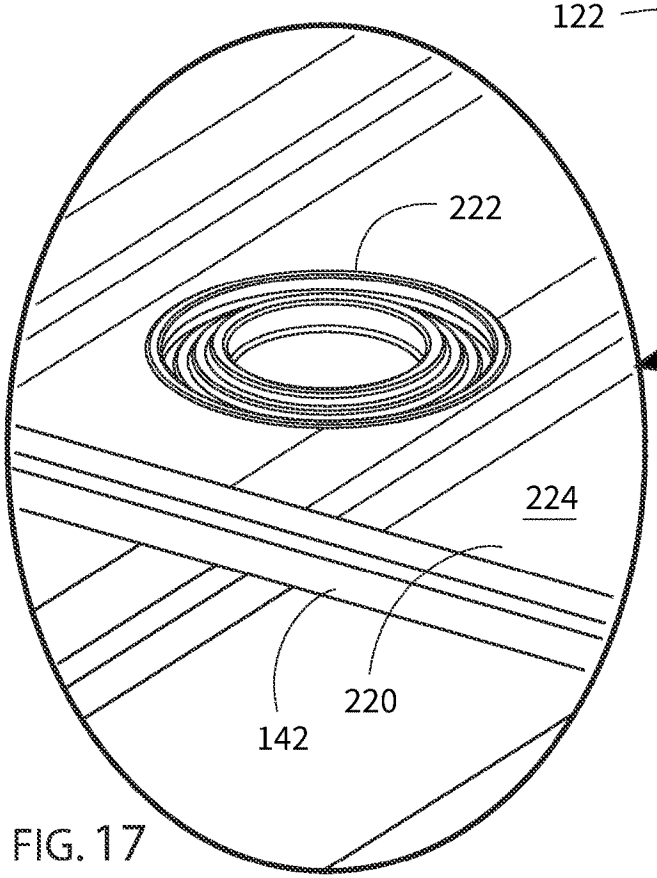
FIG. 17 provides an enlarged view of a portion of FIG. 16.
Figure 18:
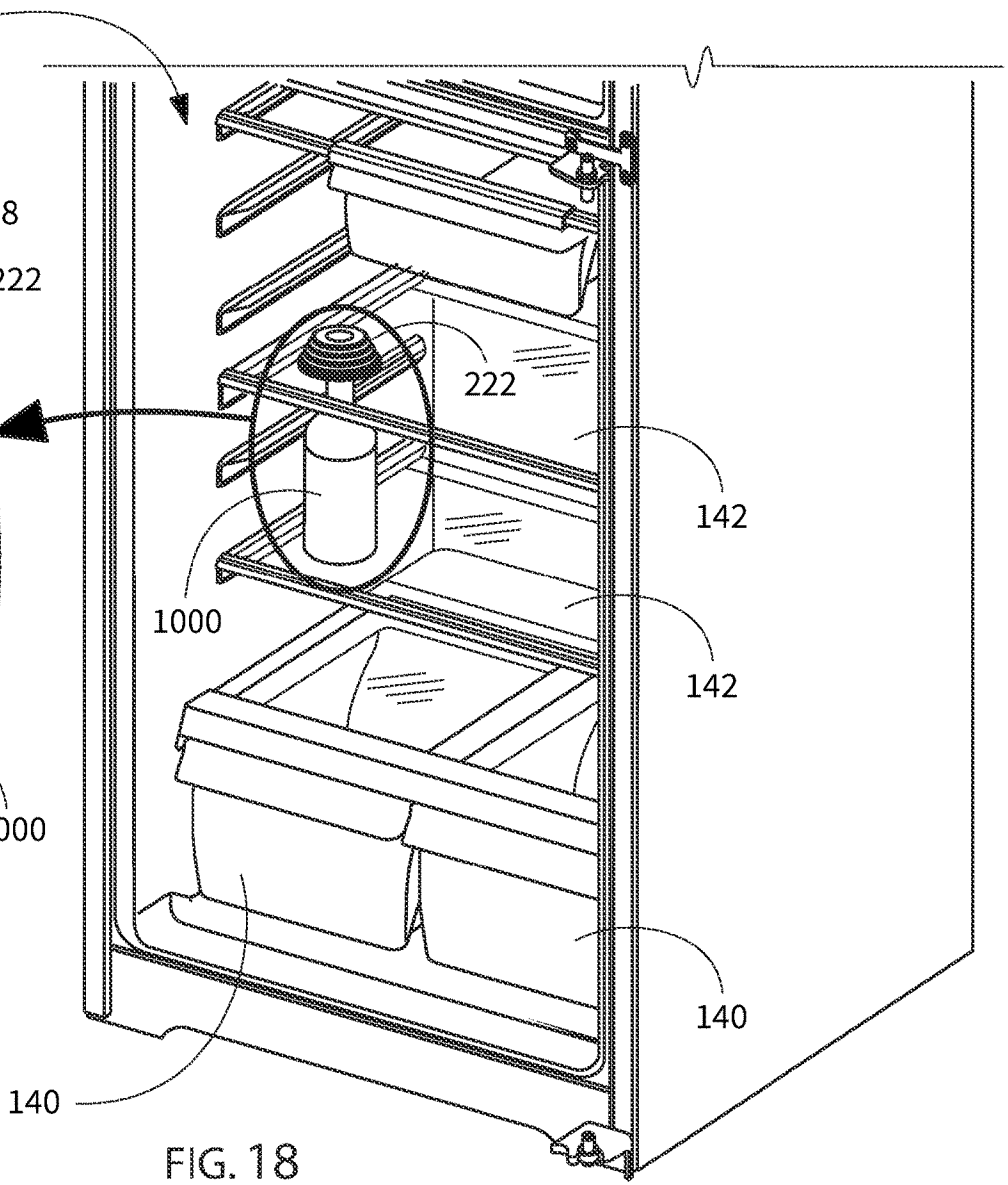
FIG. 18 provides a perspective view of a food storage chamber defined in a cabinet of a refrigerator appliance with a flexible element in an expanded position according to one or more exemplary embodiments of the present subject matter.
Figure 19:
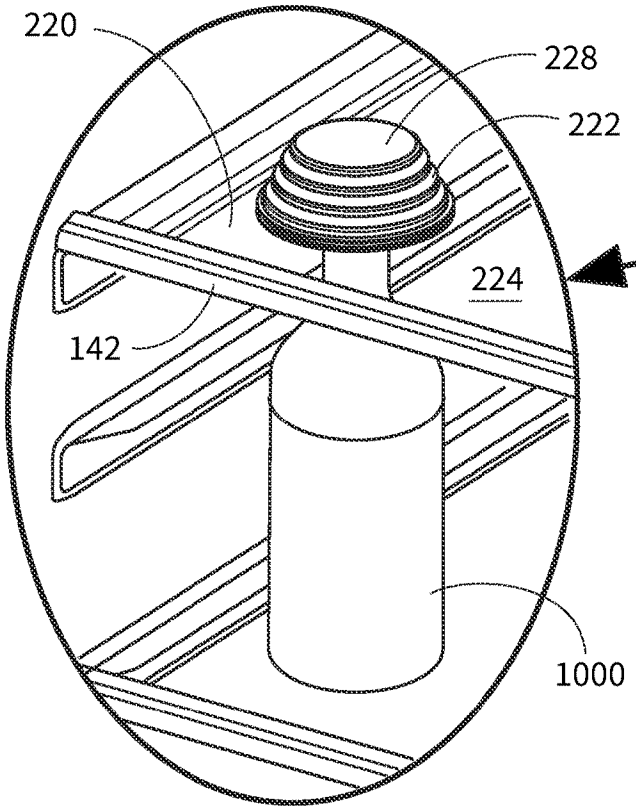
FIG. 19 provides an enlarged view of a portion of FIG. 18.

An exemplary telescopic cap 222 according to one or more embodiments of the present disclosure is illustrated in a collapsed position in FIGS. 16 and 17. As may be seen in FIGS. 16 and 17, the telescopic cap 222 may be generally flush with the platform 220 of the shelf 142 when in the collapsed position. For example, the telescopic cap 222 may include a central disk 230 (see, e.g., FIGS. 22 and 23), and a top surface 228 of the central disk 230 may be flush with an upper surface 224 of the platform 220 when the telescopic cap 222 is in the collapsed position. With the telescopic cap 222 flush with or below the upper surface 224 of the platform 220, food items may be positioned on the shelf 142, e.g., on the upper surface 224 thereof, without interference from or inhibition by the telescopic cap 222, e.g., the telescopic cap 222 does not limit the storage capacity of the shelf 142, when the telescopic cap 222 is in the collapsed position.

The exemplary telescopic cap 222 is illustrated in an expanded position in FIGS. 18 through 21. As illustrated, the telescopic cap 222 may be expanded to permit a taller food item 1000 to be stored underneath the shelf 142, such as on top of a lower shelf 142, a drawer 140, or otherwise below the shelf 142. For example, the telescopic cap 222 is illustrated in a fully expanded position in, e.g., FIG. 20, where the food item 1000 abuts the central disk 230 of the telescopic cap 222 and every fold of the telescopic cap 222 is unfolded such that the telescopic cap 222 is fully expanded. The telescopic cap 222 may also be deformable to an intermediate position, e.g., above the collapsed position but less than fully expanded, to accommodate a food item having a height that is greater than a vertical distance below the shelf 142 but that exceeds the vertical distance below the shelf 142 by less than the fully expanded height of the telescopic cap 222, e.g., where the top of such food item would still abut the central disk 230 of the telescopic cap 222 above the upper surface 224 of the platform 220 but with the folds of the telescopic cap 222 not completely unfolded.

Figure 20:
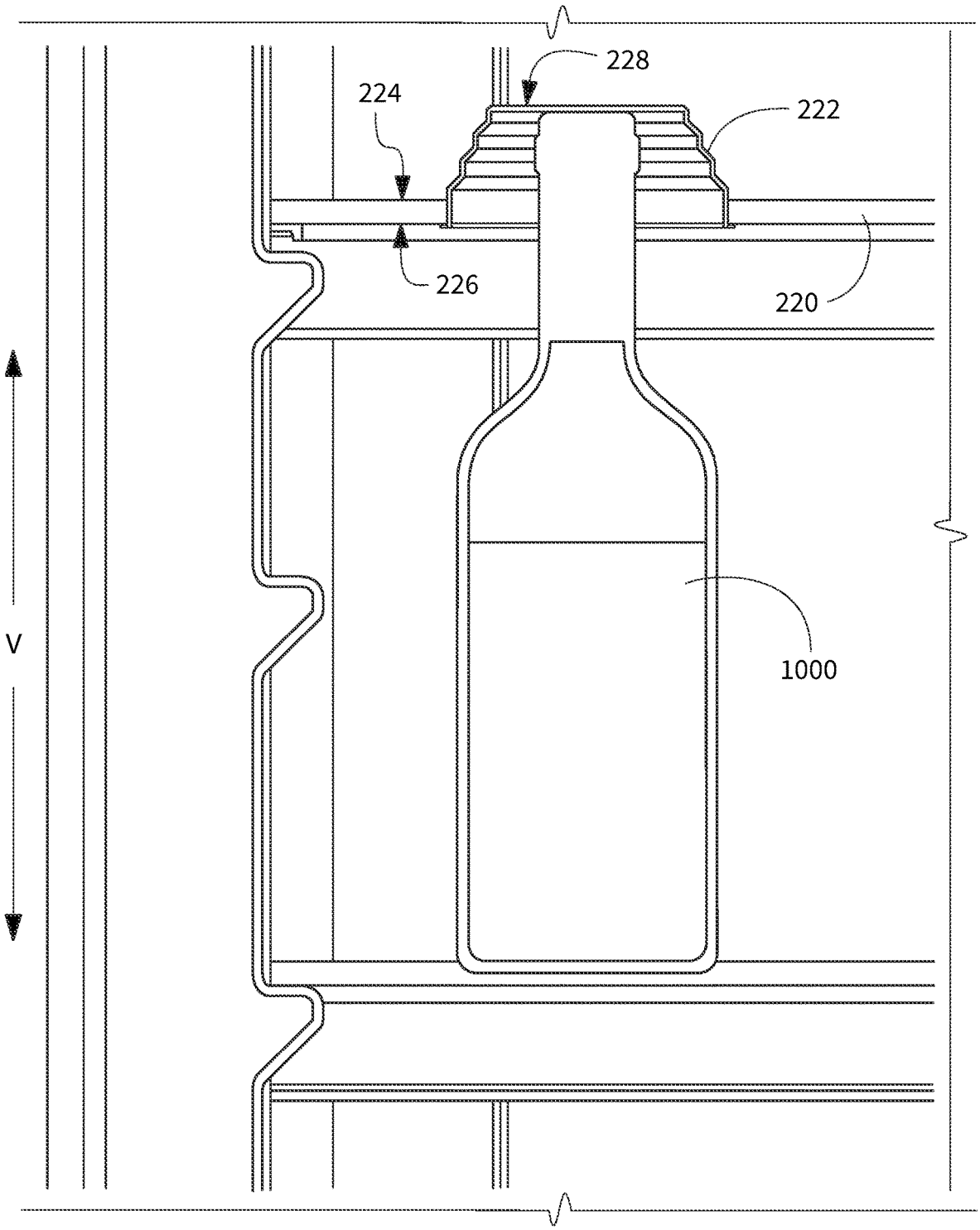
FIG. 20 provides an elevation view of a portion of the food storage chamber of FIG. 18.
Figure 21:
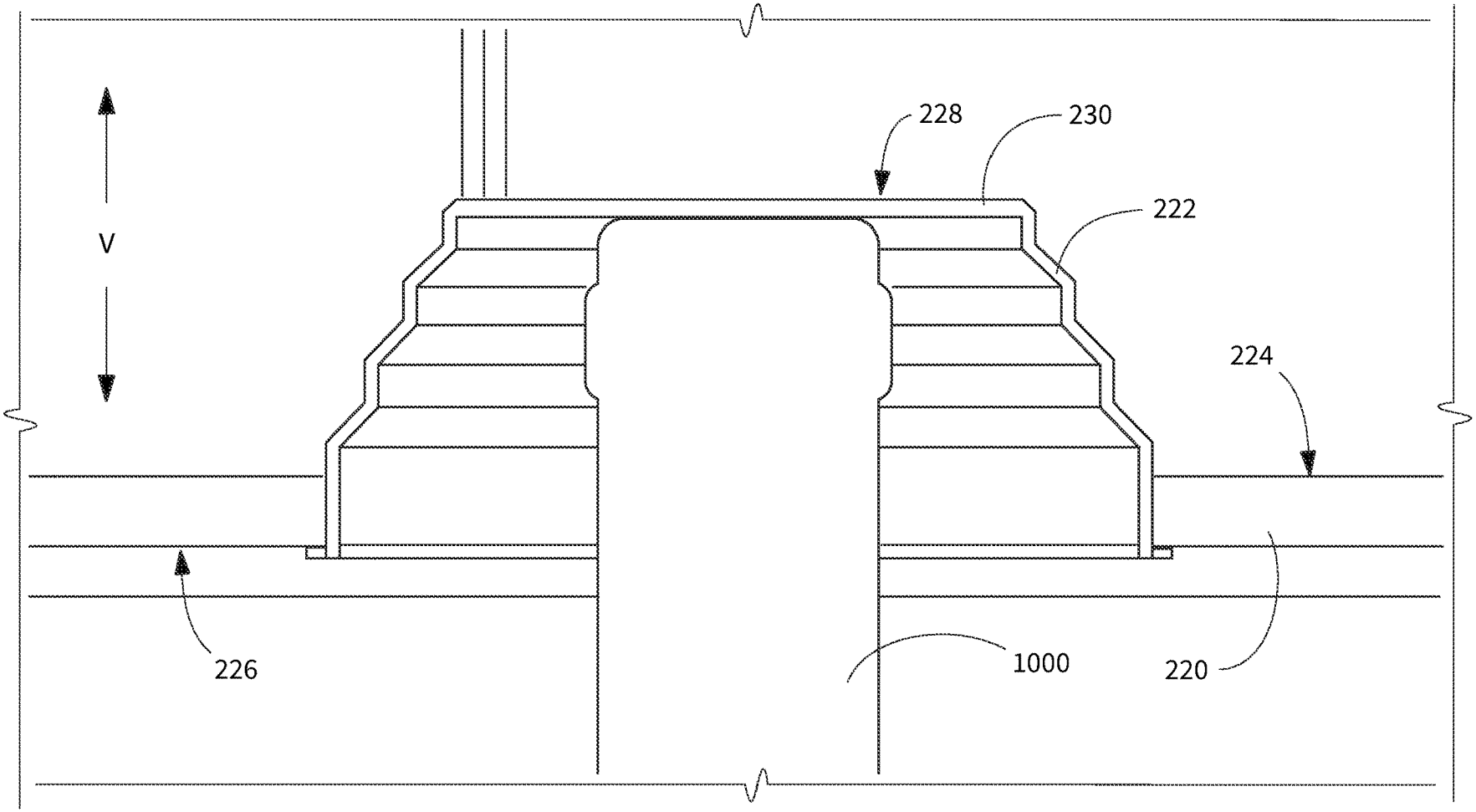
FIG. 21 provides an enlarged view of a portion of FIG. 20.

As may be seen in FIGS. 20 and 21, the platform 220 may include, e.g., may define and be bounded by along the vertical direction V, the upper surface 224 and an opposing lower surface 226. As may be seen, e.g., in FIG. 21, the telescopic cap 222 may include a flange that is mounted to the lower surface 226 of the platform 220.

Figure 23:
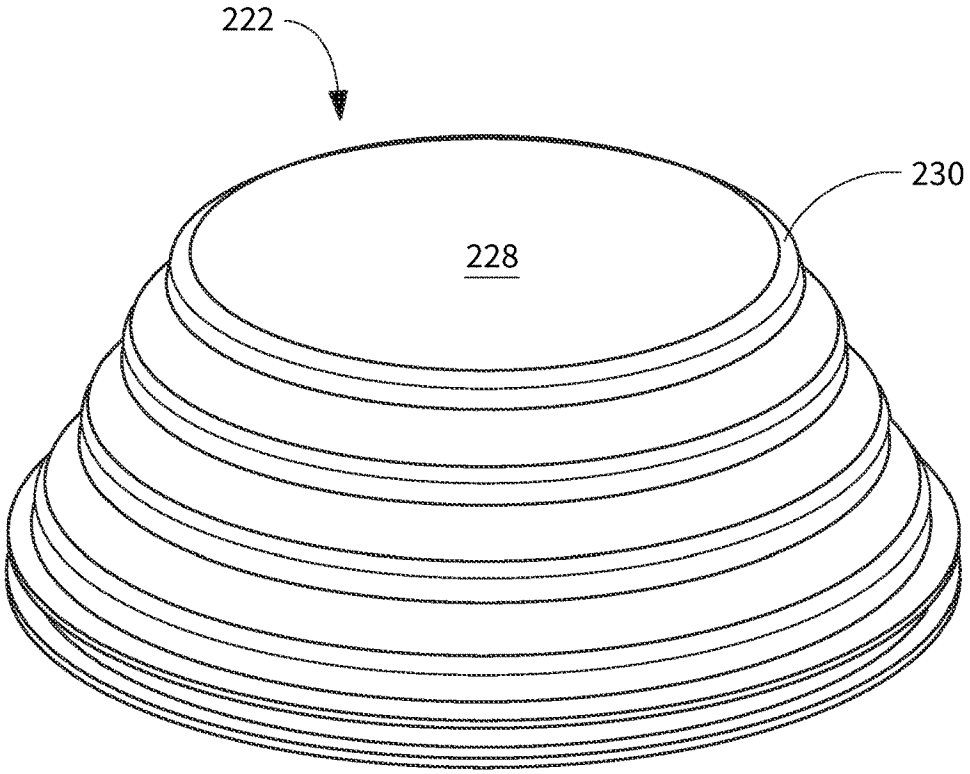
FIG. 23 provides a view of the exemplary flexible element of FIG. 22 in an expanded position.
Figure 22:
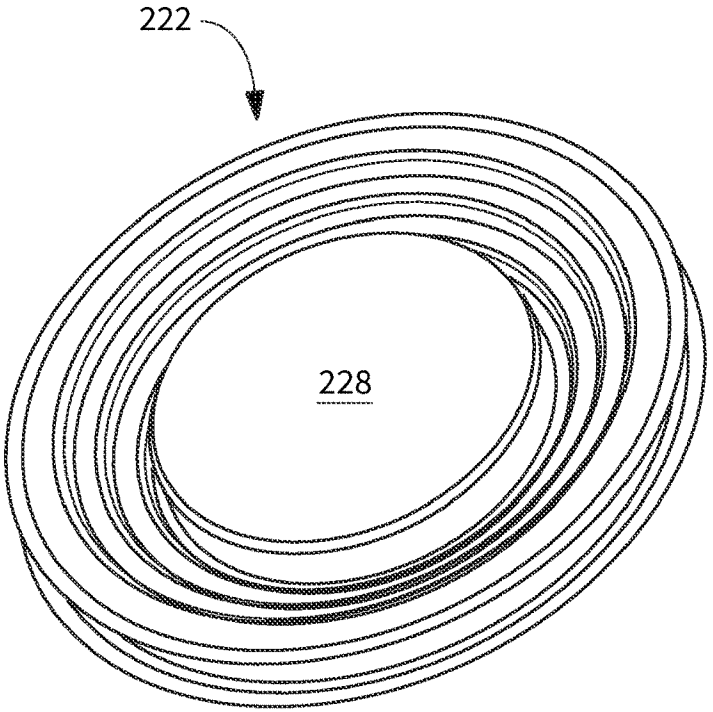
FIG. 22 provides a perspective view of an exemplary flexible element according to one or more exemplary embodiments of the present subject matter in a collapsed position.

FIG. 22 illustrates an exemplary telescopic cap 222 in a collapsed position. In such position, the telescopic cap 222 may define a height that is generally equal (e.g., within plus or minus ten percent of) to a thickness of the platform 220, e.g., from the lower surface 226 to the upper surface 224. The collapsed height of the telescopic cap 222 may also be defined by the distance from the bottom flange of the telescopic cap 222 to the first fold of the telescopic cap 222, where each successive fold of the telescopic cap 222 is concentric with and received within the lower folds of the telescopic cap 222. FIG. 23 illustrates the exemplary telescopic cap 222 in a fully expanded position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the vertical, lateral, and transverse directions being mutually perpendicular, the refrigerator appliance comprising:

a cabinet defining a food storage chamber; and a food storage unit comprising a rigid structural frame surrounding a telescopic element, the telescopic element deformable and movable relative to the rigid structural frame, and a door rotatably mounted to the cabinet, the door movable between an closed position wherein the door abuts the cabinet to sealingly enclose the food storage chamber and an open position which permits access to the food storage chamber, wherein the food storage unit is a bin mounted on an interior surface of the door whereby the bin is positioned within the food storage chamber when the door is in the closed position, the rigid structural frame is a floor of the bin oriented generally perpendicular to the vertical direction, and the telescopic element is a telescopic container that is deformable generally perpendicularly to the floor.

2. The refrigerator appliance of claim 1, wherein the telescopic container is deformable and movable downward along the vertical direction from a collapsed position to an expanded position.

3. The refrigerator appliance of claim 1, wherein the telescopic container is deformable and movable upward along the vertical direction from a collapsed position to an expanded position.

4. A refrigerator appliance, comprising:

a cabinet defining a food storage chamber; and a food storage unit comprising a rigid structural frame surrounding a telescopic element, the telescopic element deformable and movable relative to the rigid structural frame, and a door rotatably mounted to the cabinet, the door movable between an closed position wherein the door abuts the cabinet to sealingly enclose the food storage chamber and an open position which permits access to the food storage chamber, wherein the food storage unit is a bin mounted on an interior surface of the door whereby the bin is positioned within the food storage chamber when the door is in the closed position, the rigid structural frame is a floor of the bin and the telescopic element is a telescopic container that is deformable generally perpendicularly to the floor.

5. The refrigerator appliance of claim 4, wherein the telescopic container is deformable and movable downward from a collapsed position to an expanded position below the floor.

6. The refrigerator appliance of claim 4, wherein the telescopic container is deformable and movable upward from a collapsed position to an expanded position above the floor.

* * * * *